US007791983B2

(12) United States Patent
Pellaton

(10) Patent No.: US 7,791,983 B2
(45) Date of Patent: Sep. 7, 2010

(54) TIMEPIECE MOVEMENT FITTED WITH A DISPLAY MODULE

(75) Inventor: Loïc Pellaton, Neuchâtel (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 11/939,845

(22) Filed: Nov. 14, 2007

(65) Prior Publication Data

US 2008/0112273 A1 May 15, 2008

(30) Foreign Application Priority Data

Nov. 14, 2006 (EP) ..... 06124059

(51) Int. Cl.
*G04B 19/20* (2006.01)
*G04B 19/16* (2006.01)

(52) U.S. Cl. ..... 368/37; 368/233

(58) Field of Classification Search ..... 368/88, 368/28–40, 300, 232–233
See application file for complete search history.

(56) References Cited

U.S. PATENT DOCUMENTS 4,244,038 A * 1/1981 Ganter et al. ..... 368/35
4,250,573 A * 2/1981 Saito ..... 368/73
4,428,682 A * 1/1984 Winter ..... 368/238
5,282,179 A * 1/1994 Vuilleumier ..... 368/28
5,703,837 A * 12/1997 Umemoto et al. ..... 368/88
5,999,496 A * 12/1999 Chaut ..... 368/223
2006/0098535 A1* 5/2006 Marki et al. ..... 368/37
2006/0221773 A1* 10/2006 Kuepfer et al. ..... 368/37

FOREIGN PATENT DOCUMENTS

| | | |
|---|---|---|
| CH | 18737/71 | 7/1976 |
| CH | 609 825 A3 | 3/1979 |
| EP | 0 131 858 A1 | 1/1985 |
| GB | 1 471 678 | 4/1977 |

OTHER PUBLICATIONS

European Search Report issued in corresponding application No. EP 06 12 4059, completed Aug. 6, 2007.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

The invention concerns a timepiece movement of the type including a fixed support (23), fitted with a display module (24) including a central bridge (26) secured to said support (22) and an annular display member (28) with an axis AA, mounted to rotate freely substantially around the bridge (26), abutting on the support (22). The display member (28) includes a contact surface (37) and the bridge (26) includes at least one positioning surface (40) cooperating with the contact surface (37) so as to position the display member (28) axially on the support (22).

5 Claims, 3 Drawing Sheets

TIMEPIECE MOVEMENT FITTED WITH A DISPLAY MODULE

This application claims priority from European Patent Application No. 06124059.4, filed Nov. 14, 2006, the entire disclosure of which is incorporated herein by reference.

FIELD OF THE INVENTION

The present invention relates to the field of horology. It concerns more specifically a timepiece movement fitted with a display module including a central bridge and an annular type display member mounted to rotate freely about the bridge. The invention also concerns a timepiece fitted with a movement of this type and a display module.

BACKGROUND OF THE INVENTION

Timepiece movements of the aforementioned type are fitted, for example, to calendar watches. The latter include a case in which there is fixed a support, such as a bottom plate, and a display module formed of a central bridge secured to said bottom plate, a date ring, a drive member and a member for positioning the date ring. The module may further optionally include a date correction device.

Conventionally, the drive member is mounted to rotate freely in rotation on the bridge, whereas the date ring is mounted to abut against the bottom plate, free in rotation about the bridge. The positioning member occupies a housing provided for this purpose on the bridge. The axial positioning of these different elements, in the opposite direction to the bottom plate, is generally achieved by a holding plate screwed to the bridge, and extending above the latter and partially above the date ring. An example of this type of bottom plate is given in GB Patent No. 1 471 678. The holding plate, whose shape and dimensions are adapted to the display module, is formed by stamping and bending processes. The manufacturing cost of the holding plate is high since the stamp used for the cutting thereof is itself very expensive. Moreover, assembly of said plate is very expensive as it is one of the final assembly operations of the timepiece, and it is known that the final operations have a considerably higher cost price than the initial or intermediate operations.

SUMMARY OF THE INVENTION

The invention overcomes the aforementioned cost problems, since it relates to a timepiece movement that does not have a holding plate.

More specifically, the invention concerns a timepiece movement including a fixed support, said movement being fitted with a display module including a central bridge secured to the support and an annular display member with an axis AA, mounted to rotate freely substantially around the bridge, abutting against the support. According to the invention, the display member includes a contact surface and the bridge includes at least one positioning surface cooperating with the contact surface so as to position said display surface axially on said support.

Owing to the support and positioning surfaces, the display member is held axially on the support without the help of a holding plate.

In a particularly advantageous embodiment, the bridge includes three positioning surfaces, and three assembly surfaces, shifted axially and angularly relative to the positioning surfaces. The display member further includes three lugs. The contact surface, the positioning and assembly surfaces and the lugs are arranged so as to form together a bayonet assembly system for mounting the display member on the bridge.

Owing to this bayonet assembly system, the display member is assembled to the bridge independently of the fixed support, so as to form a pre-assembled display module.

The invention also concerns a display module and a timepiece including a movement fitted with such a display module.

BRIEF DESCRIPTION OF THE DRAWINGS

Other features and advantages of the present invention will appear more clearly from the following detailed description of an example embodiment of a timepiece according to the invention, this example being given purely by way of non-limiting illustration, in conjunction with the annexed drawing, in which.

DETAILED DESCRIPTION OF THE ILLUSTRATIVE EMBODIMENTS

Figure 1:
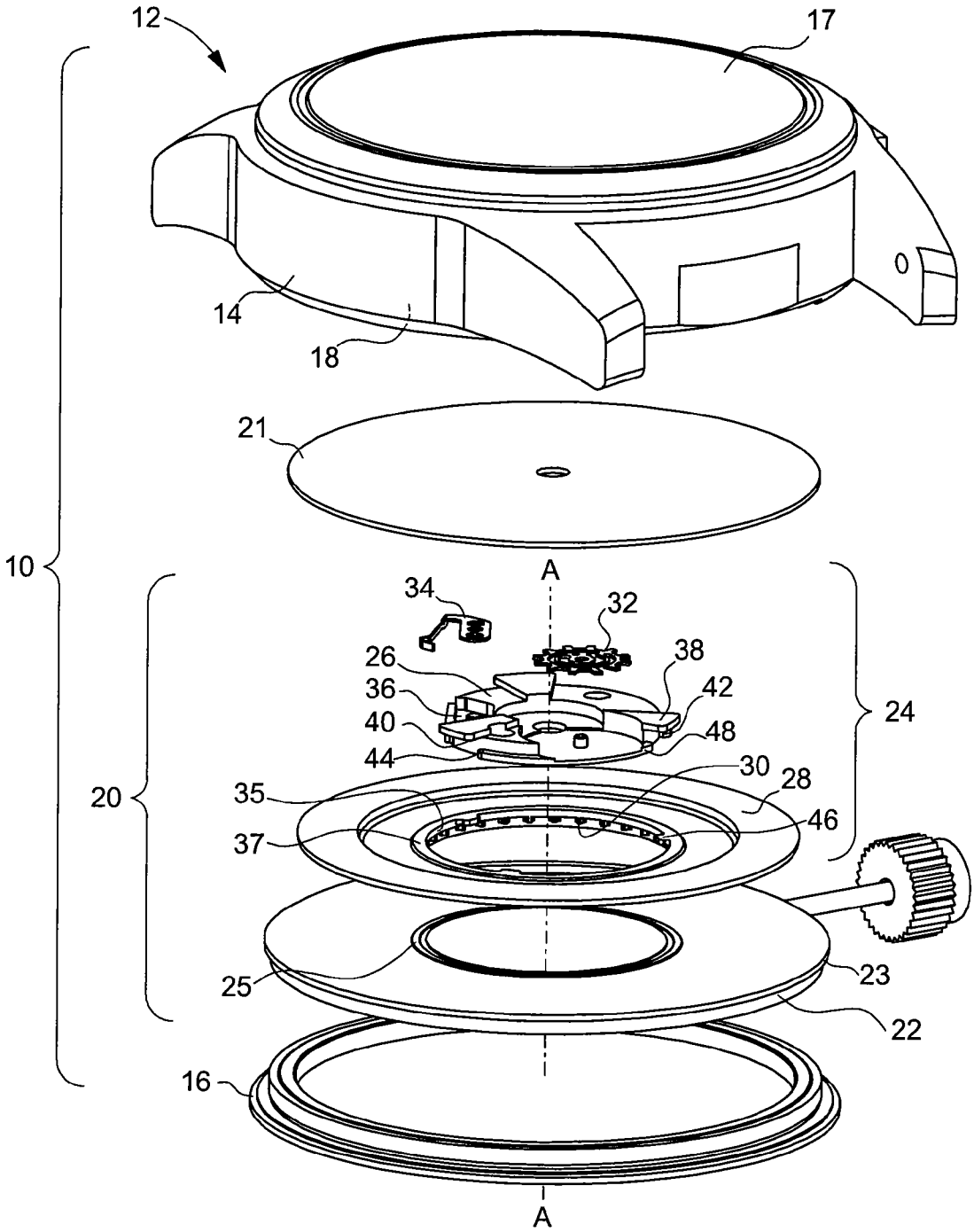
FIG. 1 is an exploded perspective view of a first embodiment of a timepiece according to the invention.

The timepiece shown in FIG. 1 and designated by the general reference 10 conventionally includes a case 12 formed of a middle part 14, a back cover 16 and a crystal 17, together defining a housing 18 containing a movement 20, and a dial 21 inserted between crystal 17 and movement 20.

Figure 2:
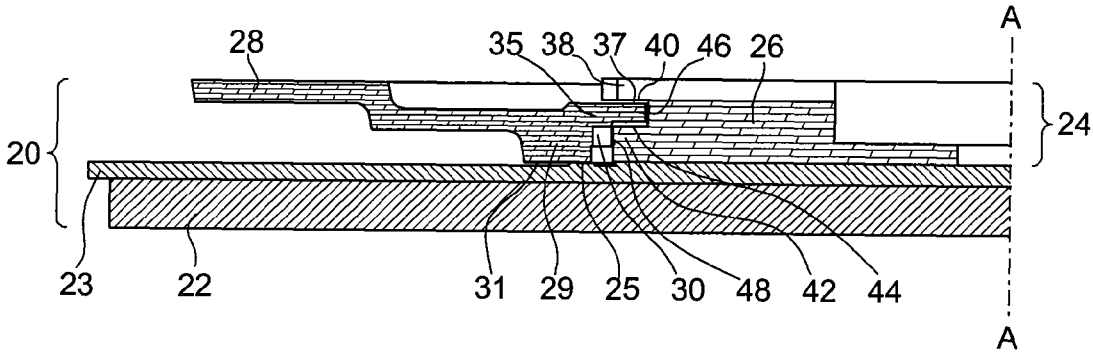
FIG. 2 is a partial cross-section of a movement fitted to said timepiece.

Movement 20 is shown in cross-section in FIG. 2. It includes a fixed support 23, such as a bottom plate, on which are mounted the members of a basic movement 22, shown schematically in FIGS. 1 and 2, via a unit secured to said bottom plate. It further includes a display module 24, mounted on the top face of bottom plate 23. The "top face" means the face directed towards dial 21, and the "bottom face" means the opposite face. The method of securing bottom plate 23 to case 1 is not shown in FIGS. 1 and 2, but it could be achieved using screws, clips, a casing ring or any other means known to those skilled in the art. The top face of bottom plate 23 is provided with a circular screw thread 25, the function of which will be specified below.

Display module 24 includes in a conventional manner a substantially circular central bridge 26 and a display ring 28 with an axis AA, coaxial to bridge 26, on which are affixed time indications, such as dates, days of the week, or even phases of the moon. Bridge 26 is rigidly secured to bottom plate 23 via screws that are not shown in FIGS. 1 and 2. Display ring 28 is mounted to rotate freely about bridge 26, abutting on bottom plate 23. For this purpose, it is provided with a substantially cylindrical portion 29 forming a support surface 31 that cooperates with the screw thread 25 so as to limit friction linked to its rotational movement. The cylindrical portion 29 is provided with a toothing 30 located on the inner flank thereof, for driving ring 28 in rotation. A drive wheel 32, mounted to rotate freely on bridge 26 and drawing its drive force from a kinematic chain driven by basic movement 22, cooperates with toothing 30. A jumper spring 34, arranged in a recess 36 provided for this purpose on bridge 26, is for the angular positioning of ring 28. Display module 24 further includes, optionally, a correction device that is not shown, preferably mounted on the bottom face of bridge 26.

According to the invention, display ring 28 is provided on the side of the inner diameter thereof, with an annular portion 35 extending radially above toothing 30 and forming a contact surface 37 oriented towards dial 21. Bridge 26 is provided, with three protruding portions 38 angularly distributed over the periphery thereof, and extending radially above contact surface 37. Said protruding portions 38 form three positioning surfaces 40 cooperating with contact surface 37 so as to position display ring 28 axially on bottom plate 23. Ring 28 is thus free in rotation and held axially, in one direction by bottom plate 23, and in the other direction by protruding portions 38.

Drive wheel 32 and jumper spring 34 are held axially on bridge 26 by means that are well known to those skilled in the art, not shown in FIG. 1. It will be noted, for example, that if bridge 26 is made of plastic material, by injection moulding, drive wheel 32 and jumper spring 34 are advantageously locked axially by thermowelding. In a variant, if bridge 26 is made conventionally of metal, by machining, drive wheel 32 and jumper spring 34 are locked, either by a screw or by a stud.

Bridge 26 is further provided with three shoulders 42, formed by annular portions that are shifted angularly and axially relative to protruding portions 38, and forming three assembly surfaces 44, oriented towards dial 21. For reasons that will appear below, the axial shift between shoulders 42 and protruding portions 38 is very slightly greater than the thickness of annular portion 35. The display ring 28 is, provided with three lugs 46 extending radially in the extension of annular portion 35, in the direction of axis AA. The assembly of annular portion 35—protruding portions 38—shoulders 42—lugs 46 forms a bayonet assembly system one part of which, formed by shoulders 42 and lugs 46, has no function at the heart of the assembled timepiece 10, but is for mounting ring 28 on bridge 26, in order to form a pre-assembled display module 24. It will be noted that the flanks of shoulders 42 further form a rotational guide surface 48 for ring 28, cooperating with the end of toothing 30.

Figure 3:
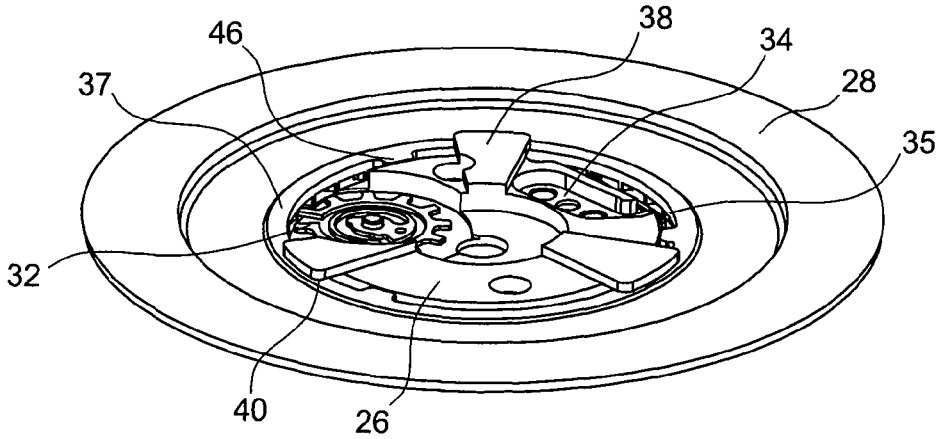
FIG. 3 is a perspective view of an assembled display module, mounted on said movement.

The pre-assembly of display module 24 is carried out as follows. Driven wheel 32 and jumper spring 34 are positioned on bridge 26 and held axially by the aforementioned means. Display ring 28 is mounted on bridge 26 via the bayonet system. For this purpose, lugs 46 are moved to face protruding portions 38, then ring 28 is rotated so as to bring lugs 46 opposite shoulders 42. In this angular position, and because the thickness of annular portion 35 is adapted to the axial distance between protruding portions 38 and shoulders 42, contact surface 37 cooperates with positioning surfaces 40 and lugs 46 cooperate with assembly surfaces 44. As a result, ring 28 is axially positioned relative to bridge 26. The display module 24 thereby pre-assembled is shown in FIG. 3.

The pre-assembly operation of display module 24 is easy and independent of the mounting assembly of base 22 of timepiece 10. This facilitates the transport of the display module and storage thereof compared to a module in separate parts, and can be carried out well before the final assembly, at lower costs. Module 24 could, for example, be pre-assembled in a first factory and transported to a second factory where it will be stored prior to being mounted on base movement 22. The assembly of the pre-assembled module is then carried out simply, by screwing bridge 26 onto bottom plate 23. Once display module 24 has been mounted on base movement 22, ring 28 rests on screw thread 25 of bottom plate 23. Shoulders 42 and lugs 46 no longer contribute to the axial positioning of ring 28 relative to bridge 26, as bottom plate 23 itself performs this function.

Figure 4:
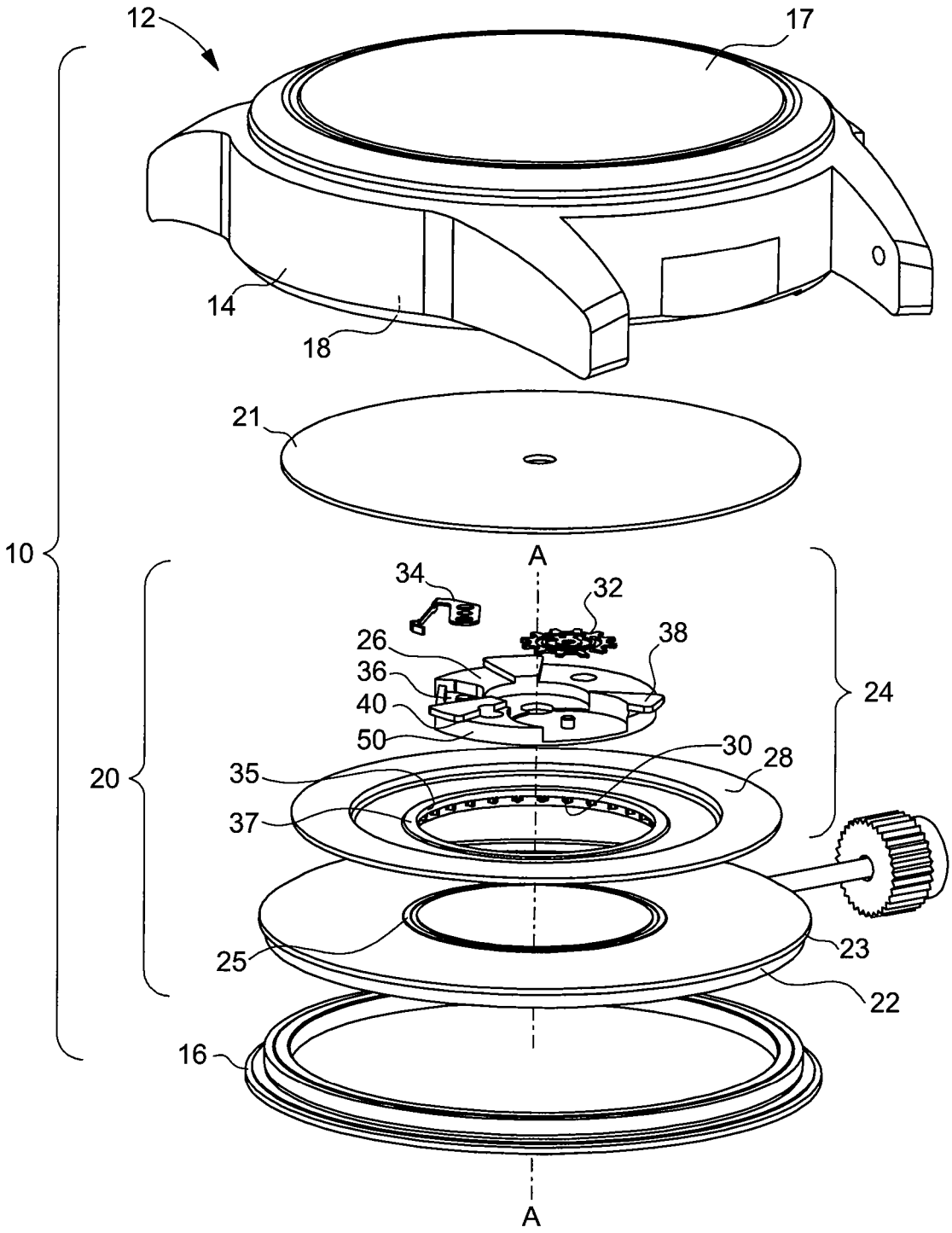
FIG. 4 is an exploded perspective view of a second embodiment of the invention according to the invention.

We will refer now to FIG. 4, illustrating a variant of the timepiece according to the invention. This embodiment differs from the preceding one in that shoulders 42 and lugs 46 are absent respectively from bridge 26 and ring 28. Display module 24 is, consequently, free of a bayonet system for assembling ring 28 on bridge 26. As it cannot be pre-assembled, module 24 is mounted piece by piece on base movement 22. Ring 28 is first of all arranged on bottom plate 23, then bridge 26 is screwed to bottom plate 26. Drive wheel 32 and jumper spring 34 are then mounted on bridge 26. As previously, the axial holding of ring 28 in the direction of dial 21 is achieved by protruding portions 38, which cooperate with annular portion 35. Likewise, drive member 32 and positioning member 34 are locked axially by the means previously described. This simplified variant of a timepiece according to the invention allows the holding plate to be omitted, but does not allow pre-assembly of display module 24. It will be noted that, in this embodiment, ring 28 is driven in rotation by the exterior flank of bridge 26, which forms a guide surface 50 cooperating with the inner flank of annular portion 35.

It goes without saying that the present invention is not limited to the embodiments that have just been described, and that various simple alterations and variants could be envisaged by those skilled in the art, without departing from the scope of the present invention as defined by the annexed claims.

It will be noted, for example, that in the second embodiment shown in FIG. 3, bridge 26 could have two protruding portions 38, or even a single protruding portion extending over a large angular sector. It will also be clear that bridge 26 could have a different geometrical shape than circular, for example, substantially triangular, without the function thereof being affected.

What is claimed is:

1. A timepiece movement, comprising:

(1) a bottom plate, and (2) a display module including (a) a central bridge secured on the bottom plate, and having at least one positioning surface, and (b) an annular display member, with a rotational axis AA, having a contact surface;

wherein the rotational axis AA passes through the central bridge, wherein the annular display member is mounted (i) to rotate freely substantially about the bridge, and (ii) to abut the bottom plate, wherein the bridge includes at least one positioning surface positioned to cooperate with the contact surface so as to position and maintain the display member, without the help of a separate holding plate, both (i) axially, in a direction opposite to that of the bottom plate, and (ii) radially, on the bottom plate about the axis AA, wherein the bridge includes three positioning surfaces formed by three protruding portions, and wherein the bridge further includes three assembly surfaces that are axially and angularly shifted relative to the positioning surfaces, and wherein the display member includes three lugs, the contact surface, the positioning and assembly surfaces and the lugs being arranged so as to form together a bayonet assembly system for mounting the display member on the bridge.

2. The timepiece movement according to claim 1, wherein the three assembly surfaces are formed by three shoulders axially and angularly shifted relative to the three protruding portions.

3. The timepiece movement according to claim 2, wherein the axial shift between the shoulders and the protruding portions is slightly greater than the thickness of the annular portion.

4. The timepiece movement according to claim 2, wherein a rotational guide surface is formed by a flank of said shoulders.

5. A timepiece, including:

(a) a central bridge, and (b) an annular display member having a rotational axis AA, and having a contact surface, wherein the rotational axis AA passes through the central bridge, wherein the central bridge includes (i) three positioning surfaces formed by three protruding lugs, and (ii) three assembly surfaces shifted axially and angularly relative to the positioning surfaces, and wherein the contact surface cooperates with the three assembly surfaces, the contact surface, the three positioning surfaces and the three assembly surfaces, and the three lugs, arranged to form a bayonet assembly system to mount the display member on the bridge, and wherein the contact surface and the three positioning surfaces position and maintain the display member, without the help of a separate holding plate, both (i) axially, in a direction opposite to that of a bottom plate, and (ii) radially on the bottom plate about the rotational axis AA.

* * * * *